United States Patent [19]

Bernstrom

[11] Patent Number: 4,741,681

[45] Date of Patent: May 3, 1988

[54] GEROTOR MOTOR WITH VALVING IN GEROTOR STAR

[76] Inventor: Marvin L. Bernstrom, 8611 Red Oak Dr., Eden Prairie, Minn. 55344

[21] Appl. No.: 858,151

[22] Filed: May 1, 1986

[51] Int. Cl.[4] ..... F03C 2/08; F04C 2/10

[52] U.S. Cl. ..... 418/61 B; 418/133; 418/186

[58] Field of Search ..... 418/61 B, 132, 133, 418/186–188

[56] References Cited

U.S. PATENT DOCUMENTS

| | | | |
|---|---|---|---|
| 3,233,524 | 2/1966 | Charlson | 418/61 B |
| 3,270,682 | 9/1966 | Charlson | 418/61 B |
| 3,825,376 | 7/1974 | Petersen et al. | 418/61 B |
| 3,894,821 | 7/1975 | White, Jr. | 418/133 |
| 4,411,606 | 10/1983 | Miller | 418/61 B |
| 4,474,544 | 10/1984 | White, Jr. | 418/186 |

*Primary Examiner*—John J. Vrablik

[57] ABSTRACT

A rotary fluid pressure device of the type including a gerotor gear set (15) including a ring member (19) and a star (23). Adjacent the gerotor set is an endcap member (17) having an end surface (41) in engagement with the adjacent end surface (42) of the star. The disclosed invention relates to valve-in-star type valving whereby both the manifold valving action and the commutating valving action occur at the interface of the surfaces (41) and (42). Specifically, fluid is communicated from the inlet port (37) through a pressure chamber (43) into a manifold zone (57) defined by the star, then through a passage (65) into fluid port (61). The ports (61) are in commutating fluid communication with a plurality of stationary valve passages (51) defined by the endcap member (17), each of which is in communication with one of the gerotor volume chambers.

8 Claims, 7 Drawing Sheets

GEROTOR MOTOR WITH VALVING IN GEROTOR STAR

BACKGROUND OF THE DISCLOSURE

The present invention relates to rotary fluid pressure devices, and more particularly, to such devices which include gerotor displacement mechanisms utilizing low-speed, commutating valving.

In conventional gerotor motors utilizing low-speed, commutating valving (i.e., the rotary valve element rotates at the speed of rotation of the gerotor star rather than the orbiting speed of the star) the valving action has been accomplished by means of a rotary valve member and a stationary valve member, with both valve members being separate and distinct from the gerotor displacement mechanism. One disadvantage of the conventional gerotor motor valving arrangements has been the occurrence of "timing" errors, especially in motor designs in which the rotary valve element was driven by the motor output shaft or the dogbone shaft. When torque wind-up of the dogbone shaft occurs, the relative position of the gerotor star and the rotary valve deviates from the theoretical position, resulting in an error in the valve "timing", i.e., the communication of fluid into and out of the volume chambers as they expand and contract. Another disadvantage of arrangements in which the stationary and rotary valve elements are separate from the gerotor mechanism is simply the excessive number of parts required and the resulting expense.

It has been recognized for a number of years that one solution to the types of problems mentioned above is the provision of a gerotor motor in which a portion of the gerotor star itself comprises the rotary valve member ("valve-in-star"). It has been recognized that a valve-in-star design should substantially eliminate valve timing errors because of the fixed relationship between the star and the rotary valve ports. In addition, having fewer elements surrounded by leakage clearances and fewer elements requiring some sort of pressure balancing results in a motor capable of achieving both higher volumetric efficiency as well as higher mechanical efficiency. U.S. Pat. No. 3,825,376 illustrates one fairly early attempt at a valve-in-star design. However, each of the rotary ports associated with the gerotor star opened directly into the volume chamber, thus interrupting the star profile, which has long been recognized as being undesirable. In addition, the device of U.S. Pat. No. 3,825,376 shows each of the rotary star ports being disposed in the star valley which means in a motor having five volume chambers, there are at least periodically times when three pockets are in a changeover condition, while only one pocket is communicating with the pressure inlet and only one pocket is communicating with the exhaust port. The result of such an arrangement will be excessive variation in motor output torque ("torque ripple"), as well as an undesirable frequency of "trapping" of fluid within the volume chambers which are momentarily not in fluid communication with either the inlet port or the outlet port.

A more recent attempt to provide a satisfactory valve-in-star gerotor motor is illustrated in U.S. Pat. No. 4,411,606, in which the "manifold valving" or directional valving occurs between the star and the endcap, while the commutating valving occurs at the axially opposite end face of the star, at the interface of the star and an adjacent valve plate. Such an arrangement effectively requires that the valving be "fixed clearance", as opposed to being pressure balanced or pressure overbalanced.

In addition, the arrangement in U.S. Pat. No. 4,411,606 requires a plurality of axial bores extending through the star to communicate between the opposite ends of the star. If such bores are fairly small, there is too much flow restriction, and too large a pressure drop within the motor, which reduces mechanical efficiency of the motor. On the other hand, if such bores are large enough to avoid excessive flow restriction, the result is a weakening of the star.

Accordingly, it is an object of the present invention to provide an improved low-speed, high-torque gerotor motor utilizing a valve-in-star design which substantially overcomes the problems of the prior art devices.

It is a further object of the present invention to provide a device in which both the manifold valving action and the commutating valving action occur at the interface of the gerotor star and the endcap disposed adjacent the star.

It is another object of the present invention to provide a device which accomplishes the above-stated objects without the need for a separate plate member disposed between the gerotor gear set and the adjacent endcap.

Low-speed, high-torque gerotor motors of the type to which this invention relates have typically been utilized in systems in which the relief valve would be set at approximately 3,500 psi, and in which the motor would operate at approximately 3,000 psi. More recently, there has been increasing demand in the marketplace for motors capable of operating at relatively higher pressures, at least intermittently, in systems in which the relief valve may be set as high as 4,500 psi or even 5,000 psi.

In the valve-in-star motor shown in above-cited U.S. Pat. No. 3,825,376, the variation in the number of volume chambers communicating with the ports, and the resulting torque ripple, make the motor shown therein unsuitable for high-pressure applications.

The motor shown in above-cited U.S. Pat. No. 4,411,606 is similarly unsuitable for high-pressure applications because of the "fixed clearance" type of valving which is inherent by virtue of valve action occurring between opposite end faces of the star and adjacent members fixed to the end surfaces of the gerotor ring. As is well known to those skilled in the art, subjecting a fixed clearance valve to relatively higher pressures would result in excessive "cross-port" leakage, and reduced volumetric efficiency.

Accordingly, it is another important object of the present invention to provide an improved low-speed, high-torque gerotor motor utilizing a valve-in-star design wherein the motor is capable of being used in relatively higher pressure applications.

SUMMARY OF THE INVENTION

The above and other objects of the present invention are accomplished by the provision of an improved rotary fluid pressure device of the general types set forth in U.S. Pat. No. 3,825,376 wherein the device comprises a housing means including an endcap member defining a fluid inlet port and a fluid outlet port; a gerotor gear set associated with the housing means and including an internally-toothed ring member, and an externally-toothed star member eccentrically disposed within the ring member. Either the ring member or the star member has orbital movement relative to the other of the members, and the star member has rotational movement relative to the ring member and the housing means. The internal teeth of the ring member and the external teeth of the star member interengage to define a plurality N+1 of expanding and contracting fluid volume chambers during the relative orbital and rotational movements. The device includes a shaft means and means operable to transmit the rotational movement of the star member to the shaft means.The endcap member defines a first fluid pressure chamber in continuous fluid communication with either the inlet port or the outlet port, and a second fluid pressure chamber in continuous fluid communication with the other of the ports, and the second fluid pressure chamber surrounds the first fluid pressure chamber. The star member defines a first manifold zone in continuous fluid communication with the first pressure chamber and a second manifold zone in continuous fluid communication with the second fluid pressure chamber. The star member includes an end surface disposed toward said endcap member and the star member defines first and second sets of fluid ports, the first set of ports being in continuous communication with the first manifold zone and the second set of ports being in continuous fluid communication with the second manifold zone.

The improved device is characterized by:

(a) the second manifold zone is generally annular and surrounds the first manifold zone;

(b) the end surface of the star member is in sliding, sealing engagement with an adjacent surface of the endcap member;

(c) the adjacent surface of the endcap member defines a plurality N+1 of valve passages, each of the valve passages being in continuous fluid communication with one of the expanding and contracting fluid volume chambers; and (d) the first and second sets of fluid ports are defined solely by the end surface of the star member and are in commutating fluid communication with the plurality N+1 of valve passages defined by the endcap member, in response to the relative rotational movement of the star member.

DESCRIPTION OF THE PREFERRED EMBODIMENTS

Figure 1:
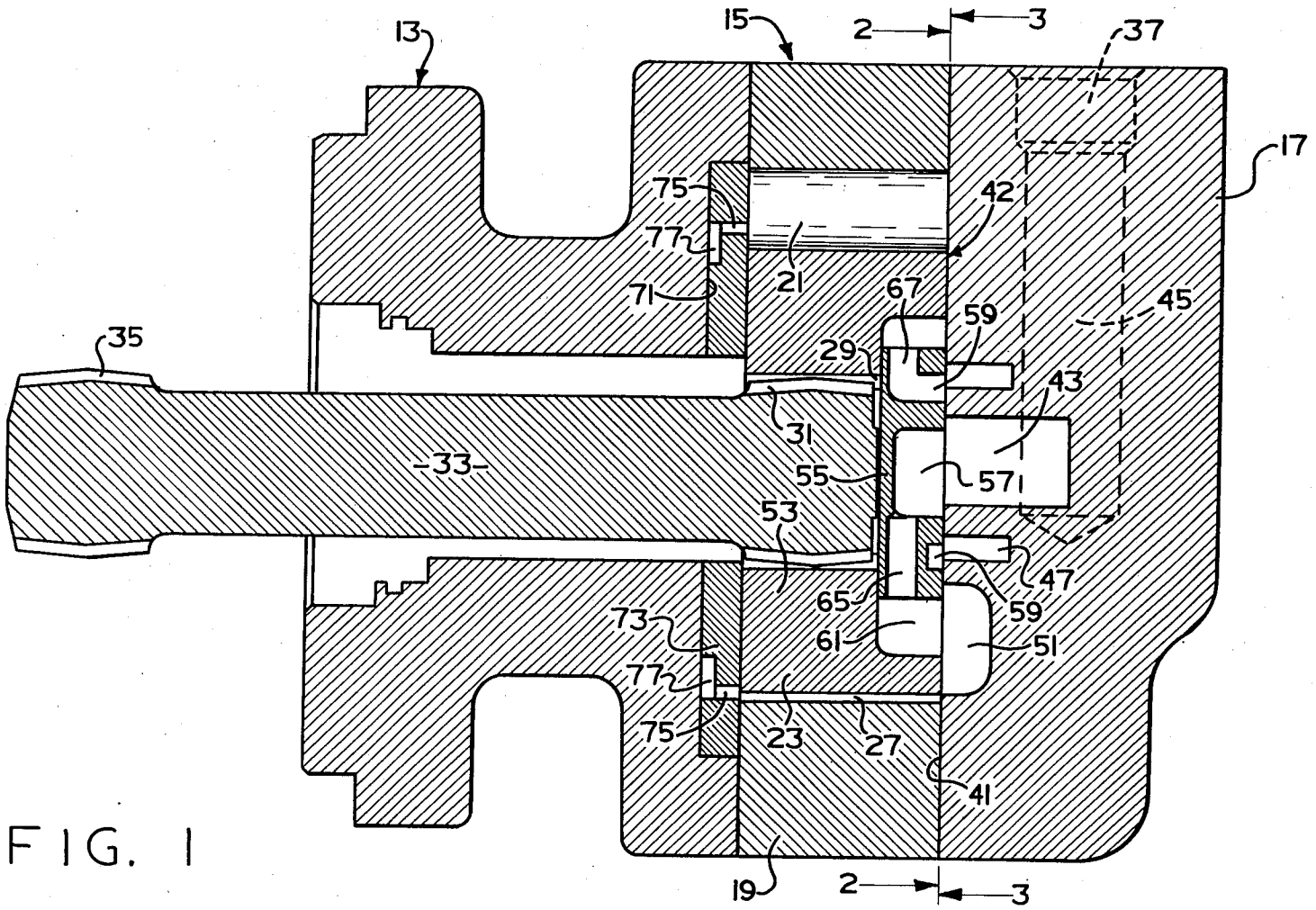
FIG. 1 is an axial cross-section, showing a low-speed, high-torque gerotor motor made in accordance with the present invention.

Referring now to the drawings, which are not intended to limit the invention, FIG. 1 illustrates a low-speed, high-torque gerotor motor. The hydraulic motor shown in FIG. 1 comprises a plurality of sections secured together, such as by a plurality of bolts 11 (shown only in FIGS. 2 and 3). The sections of the motor include a shaft housing portion 13, a gerotor displacement mechanism 15, and an endcap member 17.

The gerotor displacement mechanism 15 (best seen in FIG. 3) is well known in the art, is shown and described in great detail in U.S. Pat. No. 4,343,600, which is assigned to the assignee of the present invention, is incorporated herein by reference, and therefore will be described only briefly herein. More specifically, the displacement mechanism 15 is a Geroler® gear set comprising an internally-toothed ring member 19 defining a plurality of generally semi-cylindrical openings, with a cylindrical roller member 21 disposed in each of the openings, and serving as the internal teeth of the ring member 19. Eccentrically disposed within the ring 19 is an externally-toothed star 23, typically having one less external tooth than the number of internal teeth 21, thus permitting the star 23 to orbit and rotate relative to the ring member 19. The relative orbital and rotational movement between the ring 19 and the star 23 defines a plurality of expanding fluid volume chambers 25 and a plurality of contracting fluid volume chambers 27, as is well known in the art.

Referring again primarily to FIG. 1, the star 23 defines a plurality of straight, internal splines 29, which are in engagement with a set of external crowned splines 31 formed on one end of a main drive shaft 33. Disposed at the opposite end of the main drive shaft 33 is another set of external, crowned splines 35, adapted to be in engagement with another set of straight, internal splines defined by some form of rotary output such as a shaft or wheel hub. As is well known to those skilled in the art, gerotor motors of the type to which the invention relates may include a rotary output shaft, supported by suitable bearings, such as is illustrated in U.S. Pat. No. 4,343,600, and it will be understood that the invention is not limited to any particular configuration of output shaft. It is essential only that the device include some form of shaft means operable to transmit the rotary motion of the star 23.

In the subject embodiment, because the ring member 19 includes seven internal teeth 21, and the star 23 includes six external teeth, six orbits of the star 23 result in one complete rotation thereof and one complete rotation of the output end of the main drive shaft 33, as is well known in the art.

Figure 2:
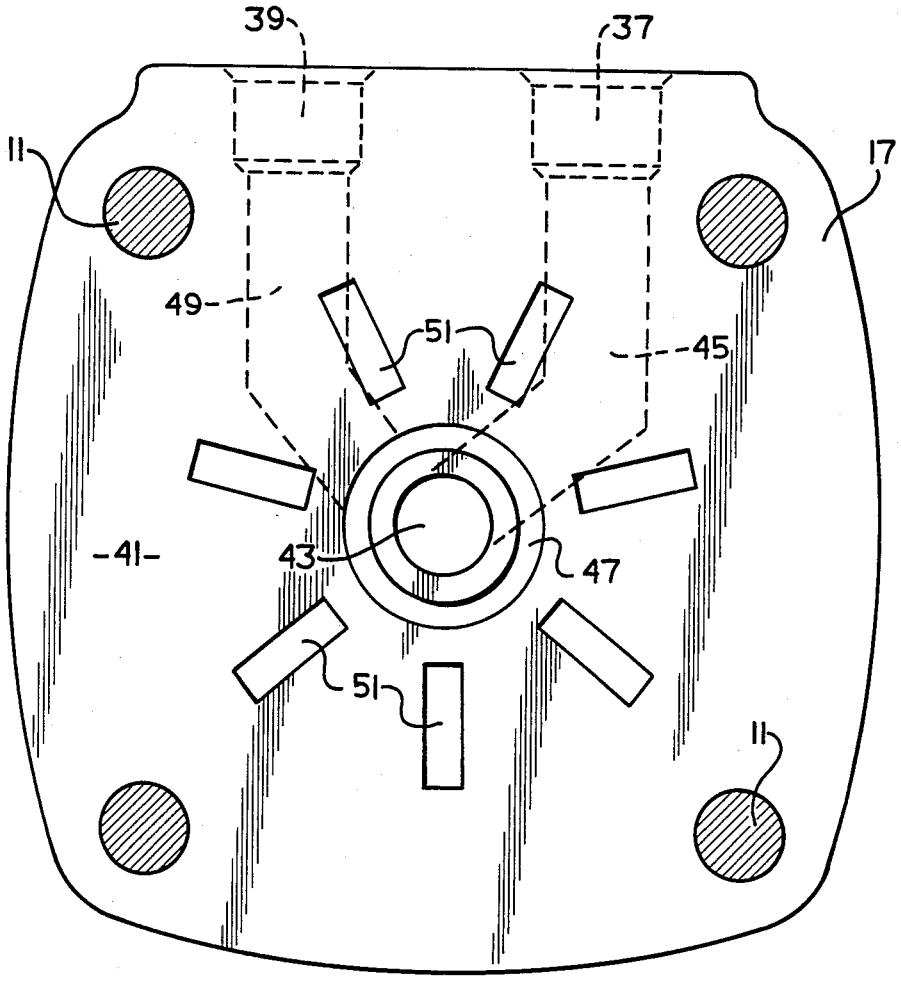
FIG. 2 is a transverse cross-section, showing the surface of the endcap member, taken on line 2—2 of FIG. 1, and on the same scale.

Referring now to FIG. 2 in conjunction with FIG. 1, the endcap member 17 includes a fluid inlet port 37 and a fluid outlet port 39. The endcap member 17 includes an end surface 41, in sliding sealing engagement with an end surface 42 (see FIG. 1) of the star 23, and disposed adjacent the gerotor gear set 15. The end surface 41 defines a fluid pressure chamber 43, which is in fluid communication with the fluid inlet port 37 by means of a passage 45. The end surface 41 further defines an annular fluid pressure chamber 47, which is preferably disposed to be concentric with the fluid pressure chamber 43. The pressure chamber 47 is in fluid communication with the fluid outlet port 39 by means of a passage 49.

The end surface 41 of the endcap member 17 further defines a plurality of stationary valve passages 51, also referred to in the art as "timing slots". In the subject embodiment, each of the valve passages 51 would typically comprise a radially-oriented, milled slot, each of which would be disposed in permanent, continuous fluid communication with an adjacent one of the volume chambers defined by the gerotor gear set 15, i.e., either an expanding volume chamber 25 or a contracting volume chamber 27. Preferably, the valve passages 51 are disposed in a generally annular pattern which is concentric relative to the fluid pressure chambers 43 and 47, as is illustrated in FIG. 2. As is well known to those skilled in the art, the valve passages 51 could have various other shapes, but the passages 51 have been shown herein as generally rectangular for ease of illustration.

It is an important aspect of the present invention that, unlike above-cited U.S. Pat. No. 3,825,376, the passages which are in direct fluid communication with the volume chambers 25 and 27 are part of the "stationary valve member", in this case the endcap member 17. As a result, each volume chamber has a stationary valve passage in continuous fluid communication therewith, at all times, such that there is never more than one volume chamber in a "changeover" condition. Therefore, in a 6–7 gerotor of the type shown herein, there are always three volume chambers in communication with the inlet port 37, and at the same time, there are always three volume chambers in communication with the outlet port 39. This arrangement reduces torque ripple and trapping of fluid within the volume chambers. The feature described hereinabove is, in general, well known to those skilled in the art of low-speed, commutating valving for gerotor motors. However, prior to the present invention it has been unknown to provide a valve-in-star gerotor motor, with both the manifold valving and commutating valving occurring at an end surface between the gerotor star and adjacent endcap, wherein there is a stationary valve port or passage providing open, continuous communication with each volume chamber.

Figure 3:
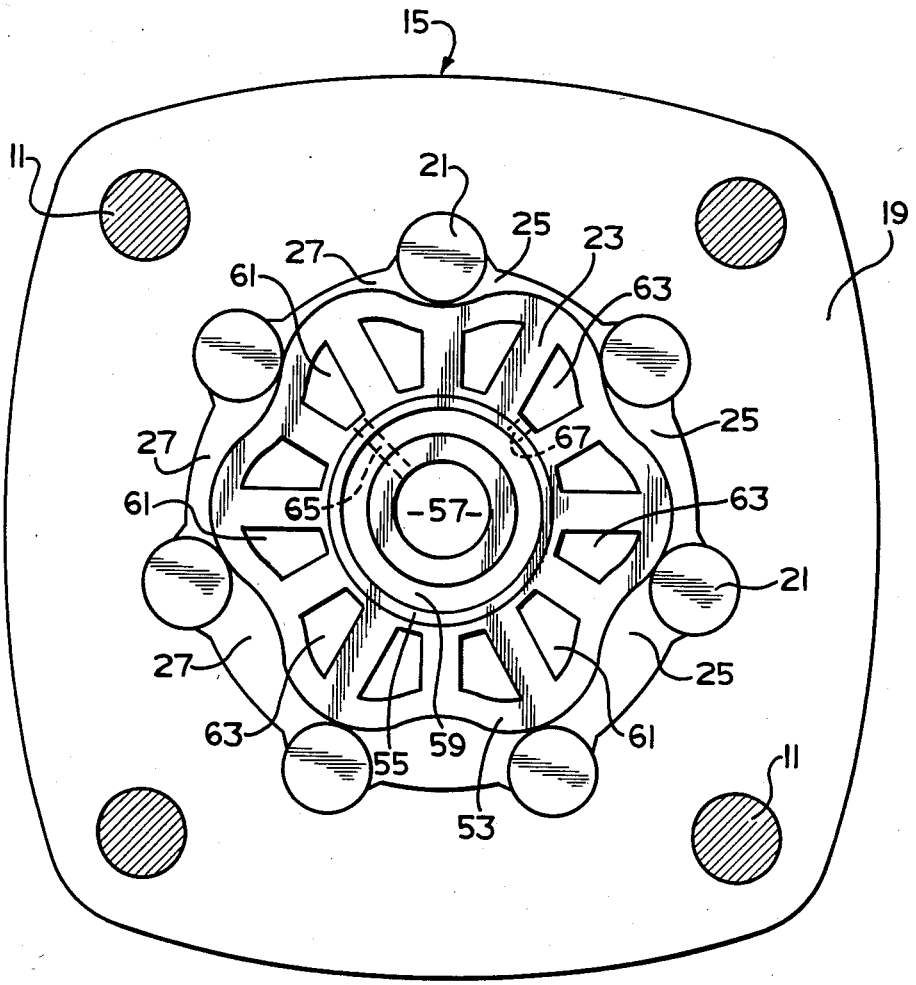
FIG. 3 is a transverse cross-section, showing the end surface of the gerotor gear set adjacent the endcap, taken on line 3—3 of FIG. 1, and on the same scale.

Referring now primarily to FIG. 3, in conjunction with FIG. 1, the externally-toothed star 23 will be described in greater detail. Although not an essential feature of the present invention, it is preferable that the star 23 comprise an assembly of two separate parts. In the subject embodiment, the star 23 comprises two separate powdered metal (PM) parts including a main portion 53, which includes the external teeth, and an insert or plug 55. The main portion 53 and the insert 55 cooperate to define the various fluid zones, passages and ports which will be described subsequently.

The star 23 defines a central manifold zone 57, which is in continuous fluid communication with the pressure chamber 43. Concentric with the zone 57 is another manifold zone 59, which is in continuous fluid communication with the annular pressure chamber 47. The end surface 42 of the star 23 defines a set of fluid ports 61 and, alternating with the fluid ports 61, a set of fluid ports 63. Each of the fluid ports 61 is in continuous fluid communication with the central manifold zone 57 by means of a fluid passage 65 (only one of which is shown in FIG. 3), while each of the fluid ports 63 is in continuous fluid communication with the concentric manifold zone 59 by means of a passage 67 (only one of which is shown in FIG. 3).

As is well known to those skilled in the art, because there are, in the preferred embodiment, seven of the internal teeth 21 there are seven of the valve passages 51. Furthermore, because there are six external teeth on the star 23, there are six of the fluid ports 61 and six of the fluid ports 63. Assuming for purposes of description that pressurized fluid is communicated to the inlet port 37, there will also be high-pressure fluid in the passage 45, in the pressure chamber 43 defined by the endcap member 17, and in the central manifold zone 57 defined by the star 23. High-pressure fluid in the zone 57 is communicated through the plurality of passages 65 to each of the fluid ports 61. As is well known to those skilled in the art, as the star 23 orbits and rotates relative to the ring member 19, the set of six fluid ports 61 engage in a low-speed, commutating valving action with respect to the valve passages 51. The result is that communication occurs only between the fluid ports 61 and the passages 51 which are instantaneously in fluid communication with expanding volume chambers 25. At the same time, low-pressure exhaust fluid is communicated from the contracting volume chambers 27 through those valve passages 51 which are instantaneously in communication therewith, and exhaust fluid then flows into those fluid ports 63 which are in communication with the particular valve passages 51 which are receiving exhaust fluid. Exhaust fluid then flows through the respective passages 67 to the concentric manifold zone 59 which remains in continuous fluid communication with the annular pressure chamber 47 during orbital and rotational movement of the star 23. Exhaust fluid then flows from the chamber 47 through the passage 49 to the fluid outlet port 39.

Referring now primarily to FIG. 1 again, it may be seen that the shaft housing portion 13 defines a recess 71, and seated within the recess 71 is a pressure balancing plate 73. The balancing plate 73 defines a plurality of openings 75, each of which is in communication with one of the volume chambers 25 or 27. Each of the openings 75 communicates with a pressure balancing recess 77 which is disposed on the side of the plate 73 opposite the gerotor gear set 15. Items 71 through 77 have been recited hereinabove primarily for the purpose of completeness, but because pressure balancing is generally well known in the art of gerotor motors and forms no essential part of the present invention, there will be no further, detailed description of the pressure balancing plate 73 or the size or shape of the pressure balancing recesses 77. It will be understood by those skilled in the art that the pressure balancing plate 73 may be used either to "balance" the star 23 in the axial direction (such that the hydraulic forces acting on the star 23 in opposite directions or approximately the same) are, alternatively, the pressure balancing plate 73 may be used to "overbalance" the star 23 into tight sealing engagement with the end surface 41 of the endcap member 17.

As mentioned in the background of the present specification, it is an important aspect of the present invention that at valve-in-star motor made in accordance with the invention is suitable for relatively higher pressure applications. As is well known to those skilled in the art, it is important to be able to pressure balance or pressure overbalance the valve in a motor which is to be used at higher pressures. Therefore, it is an important feature of the invention that, unlike the motor shown in U.S. Pat. No. 4,411,606, the motor of the present invention has both the manifold valving and the commutating valving occurring at the interface of one end of the gerotor and the adjacent endcap. As a result, because the axially opposite end of the gerotor star is not involved in the valving action, it is possible to locate some form of pressure balancing arrangement adjacent that opposite end face of the star. Therefore, one pressure balancing plate, under the influence of high-pressure fluid, substantially eliminates the leakage clearances which normally exist adjacent the end surfaces of a gerotor star, and at the same time, achieve the desired level of pressure balancing of the gerotor star against the adjacent surface of the endcap member 17.

Figure 5:
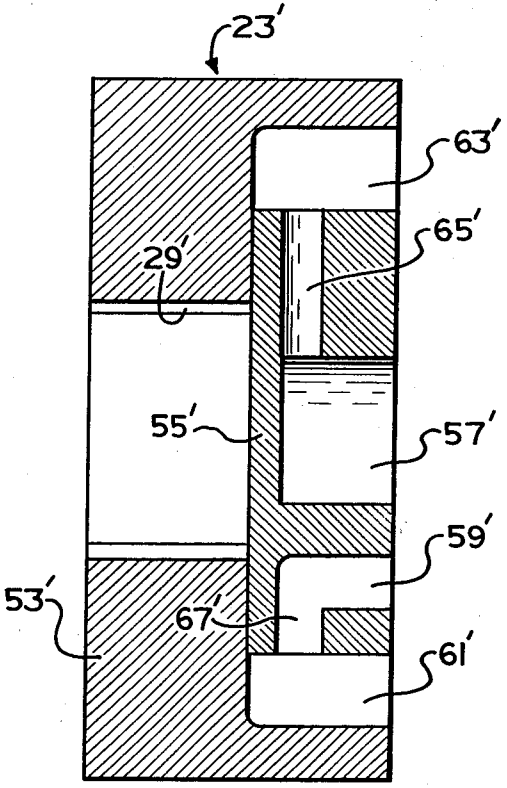
FIG. 5 is an axial cross-section, taken on line 5—5 of FIG. 4, and on the same scale as FIG. 4.
Figure 4:
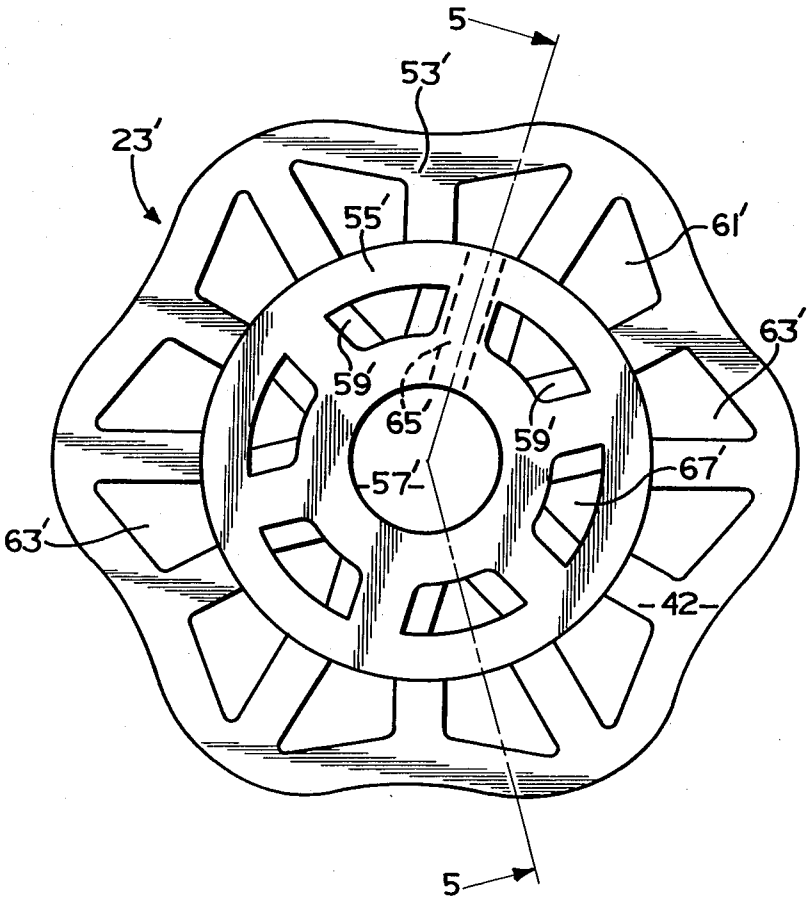
FIG. 4 is an enlarged plan view, similar to FIG. 3, showing a preferred embodiment of a gerotor star made in accordance with the present invention.

Referring now primarily to FIGS. 4 and 5, there is illustrated an alternative, but probably preferred, embodiment of the star 23 and in which elements which are the same or functionally equivalent to those shown in the embodiment of FIG. 3 have the same reference numerals, accompanied by a prime. The star 23' defines a central manifold zone 57', and concentric therewith is a plurality of manifold zones 59' which are arranged in an annular pattern. Therefore, when the manifold zone (59 or 59') is referred to as being "generally annular", the reference is to the overall shape, but it is not an essential feature of the present invention that the manifold zone (59 or 59') be continuous.

The end surface 42' of the star 23' defines a set of fluid ports 61' and, alternating therewith, a set of fluid ports 63'. Each of the fluid ports 61' is in continuous fluid communication with the manifold zone 57' by means of a fluid passage 65', while each of the fluid ports 63' is in continuous fluid communication with one of the manifold zones 59' by means of a passage 67'.

EMBODIMENT OF FIGS. 6–8

Figure 6:
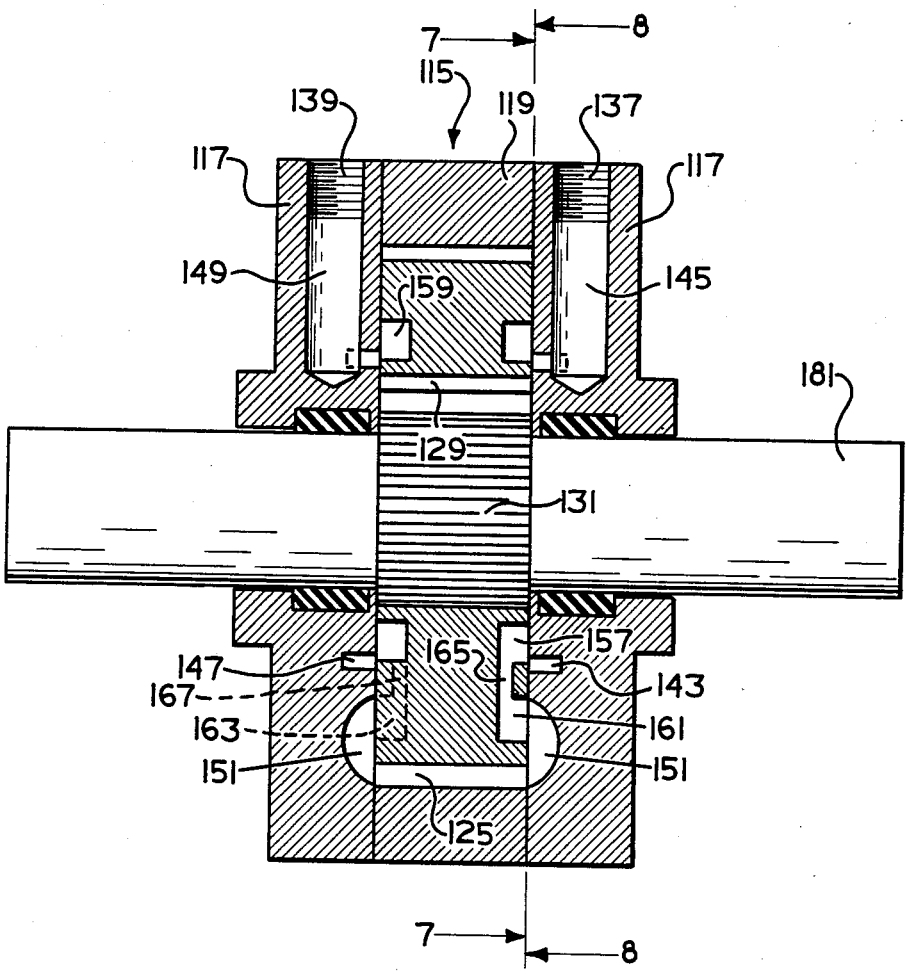
FIG. 6 is an axial cross-section of a through-shaft embodiment of the present invention.
Figure 7:
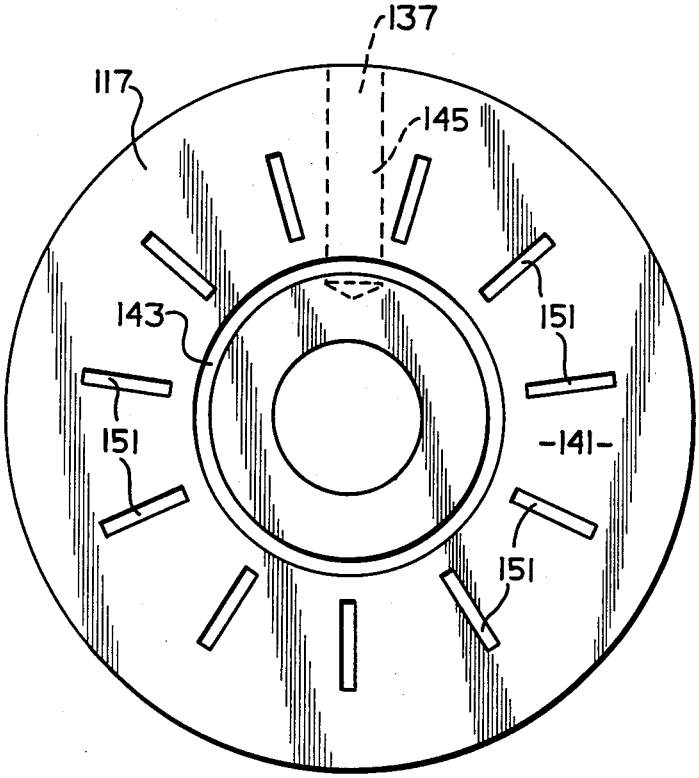
FIG. 7 is a transverse cross-section, showing the surface of the endcap member, taken on line 7—7 of FIG. 6, and on the scale.
Figure 8:
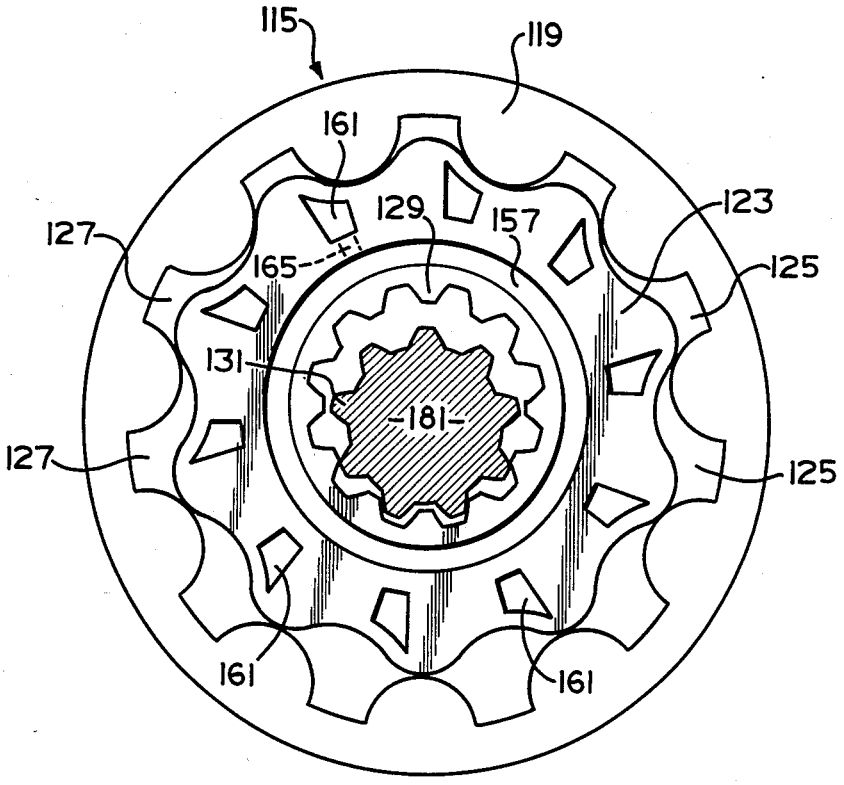
FIG. 8 is a transverse cross-section illustrating an end surface of the gerotor gear set, taken on line 8—8 of FIG. 6 and on the same scale.

Referring now to FIG. 6, there is illustrated an alternative embodiment of the present invention in which the invention is applied to a through-shaft motor. In the embodiment of FIGS. 6–8, elements which are the functional equivalent of those in FIGS. 1–5 will bear the same reference numerals, plus 100. As may best be seen in FIG. 6, the motor of the alternative embodiment includes a gerotor displacement mechanism 115, and a pair of substantially identical endcap members 117, disposed on either side of the gerotor gear set 115.

Referring now to FIG. 8, in conjunction with FIG. 6, the gerotor gear set of this embodiment comprises an internally-toothed ring member 119, and eccentrically disposed within the ring 119 is an externally-toothed star 123. The orbital and rotational movement of the star 123 relative to the ring 119 defines a plurality of expanding volume chambers 125 and a plurality of contracting volume chambers 127. The star 123 defines a plurality of straight, internal splines 129, which are in engagement with a set of straight, external splines 131 formed about the middle of an output shaft 181, which extends axially outwardly through each of the endcap members 117, whereby such motors are referred to as "through-shaft" motors. As in generally understood by those skilled in the art, because there are more of the internal splines 129 than there are of the external splines 131, one revolution of the star 123 will result in slightly more than one revolution of the output shaft 181. However, motors of the type illustrated in FIGS. 6–8 are still considered to be low-speed, high-torque motors.

Referring now to FIG. 7, in conjunction with FIG. 6, one of the endcap members 117 will be described in detail, it being understood that the description is equally applicable to the other endcap member 117. In FIG. 7, the endcap member 117 includes a fluid inlet port 137 which communicates with an annular fluid pressure chamber 143 by means of a passage 145.

The end surface 141 of the endcap member 117 defines a plurality of stationary valve passages 151, the embodiment of FIGS. 6–8 including 11 of the valve passages 151 because the gerotor gear set 115 includes 11 volume chambers. As in the embodiment of FIGS. 1–5, the valve passages 151 are preferably arranged in an annular pattern which is concentric about the annular pressure chamber 143.

Referring now primarily to FIG. 8, in conjunction with FIG. 6, the star 123 defines an annular manifold zone 157 which is in continuous fluid communication with the annular pressure chamber 143 as the star 123 orbits and rotates. The end surface of the star 123 defines a set of fluid ports 161, in the subject embodiment there being ten of the fluid ports 161 corresponding to ten external teeth on the star 123. Each of the fluid ports 161 is in continuous fluid communication with the manifold zone 157 by means of a passage 165 (only one of which is shown in FIG. 8).

In operation, assuming that pressurized fluid is communicated to the inlet port 137, the result will be high pressure in the passage 145, in the annular pressure chamber 143, and in the annular manifold zone 157. This high pressure is then communicated through each of the passages 165 into each of the fluid ports 161. As was described in connection with the embodiment of FIGS. 1–5, at any point in time, only those valve passages 151 which are in communication with expanding volume chambers 125 will be in fluid communication with the fluid ports 161. Thus, high pressure is communicated to each of the expanding volume chamber 125. At the same time, each of the contracting volume chambers 127 communicates through its respective valve passages 151 with a fluid port 163, each of the ports 163 being in communication by means of a fluid passage 167 with a concentric manifold zone 159. The manifold zone 159 is in continuous fluid communication with an annular fluid pressure chamber 147 which is in communication with a fluid outlet port 139 by means of a passage 149.

It is an important aspect of the present invention that all manifold valving action and all commutating valving action can be performed at the interface of the gerotor star and an adjacent surface of an endcap. As a result, the invention can be applied advantageously to a relatively high-pressure motor, such as the embodiment of FIGS. 1–5, in which both the manifold valving and commutating valving for both inlet and outlet flows occurs at the same interface. Alternatively, the invention can also be applied to a through-shaft motor, as in the embodiment of FIGS. 6–8, in which both the manifold and commutating valve action for inlet flow occurs on one end of the star and both the manifold and commutating valve action for outlet flow occurs on the opposite end of the star.

I claim:

1. A rotary fluid pressure device of the type comprising housing means including an endcap member defining a fluid inlet port and a fluid outlet port; a gerotor gear set associated with said housing means and including an internally-toothed ring member, and an externally-toothed star member eccentrically disposed within said ring member; one of said ring member and said star member having orbital movement relative to the other of said members, and said star member having rotational movement relative to said ring member and said housing means; the internal teeth of said ring member and the external teeth of said star member interengaging to define a plurality N+1 of expanding and contracting fluid volume chambers during said relative orbital and rotational movements; shaft means and means operable to transmit said rotational movement of said star member to said shaft means; said endcap member defining a first fluid pressure chamber in continuous fluid communication with said one of said fluid inlet port and said fluid outlet port, and a second fluid pressure chamber in continuous fluid communication with the other of said fluid inlet port and said fluid outlet port, said second fluid pressure chamber surrounding said first fluid pressure chamber; said star member defining a first manifold zone in continuous fluid communication with said first fluid pressure chamber, and a second manifold zone in continuous fluid communication with said second fluid pressure chamber; said star member including an end surface disposed toward said endcap member and defining first and second sets of fluid ports, said first set of fluid ports being in continuous fluid communication with said first manifold zone, and said second set of fluid ports being in continuous fluid communication with said second manifold zone, characterized by:

(a) said second manifold zone being generally annular and surrounding said first manifold zone;

(b) said end surface of said star member being in sliding, sealing engagement with an adjacent surface of said endcap member;

(c) said adjacent surface of said endcap member defines a plurality N+1 of value passages, each of said valve passages being in continuous fluid communication with one of said expanding and contracting fluid volume chambers; and (d) said first and second sets of fluid ports being defined solely by said end surface of said star member and being in commutating fluid communication with said plurality N+1 of valve passages defined by said endcap member in response to said relative rotational movement of said star member.

2. A rotary fluid pressure device as claimed in claim 1 characterized by said first set of fluid ports being in fluid communication with said first manifold zone by means of a first plurality of fluid passages disposed entirely within said star member.

3. A rotary fluid pressure device as claimed in claim 1 characterized by said second set of fluid ports being in fluid communication with said second manifold zone by means of a second plurality of fluid passages defined by said star member.

4. A rotary fluid pressure device as claimed in claim 1 characterized by said plurality N+1 of valve passages defined by said adjacent surface of said endcap being disposed in a generally annular pattern which is generally concentric about said second fluid pressure chamber.

5. A rotary fluid pressure device as claimed in claim 1 characterized by each of said first and second sets of fluid ports defined by said end surface of said start member comprising a plurality N of fluid ports.

6. A rotary fluid pressure device as claimed in claim 1 characterized by said star member including a second, axially opposite end surface, and said housing means including pressure balancing means disposed in sealing engagement with said second end surface.

7. A rotary fluid pressure device of the type comprising housing means including an endcap member defining a fluid inlet port and a fluid outlet port; a gerotor gear set associated with said housing means and including an internally-toothed ring member, and an externally-toothed star member eccentrically disposed within said ring member; one of said ring member and said star member having orbital movement relative to the other of said members, and said star member having rotational movement relative to said ring member and said housing means; the internal teeth of said ring member and the external teeth of said star member interengaging of define a plurality of N+1 of expanding and contracting fluid volume chambers during said relative orbital and rotational movements; shaft means and means operable to transmit said rotational movement of said star member to said shaft means; said endcap member defining a first fluid pressure chamber in continuous fluid communication with said one of said fluid inlet port and said fluid outlet port, and a second fluid pressure chamber in continuous fluid communication with the other of said fluid inlet port and said fluid outlet port, said second fluid pressure chamber surrounding said first fluid pressure chamber; said star member defining a first manifold zone in continuous fluid communication with said first fluid pressure chamber, and a second manifold zone in continuous fluid communication with said second fluid pressure chamber and being generally annular and surrounding said first manifold zone; said star member including an end surface defining first and second pluralities N of fluid ports, said first plurality N of fluid ports being in continuous fluid communication with said first manifold zone and said second plurality N of fluid ports being in continuous fluid communication with said second manifold zone; means defining a plurality N+1 of valve passages, each of said valve passages being in continuous fluid communication with one of said expanding and contracting fluid volume chambers; said first and second pluralities N of fluid ports being in commutating fluid communication with said plurality N+1 of valve passages in response to said relative rotational movement of said star member, characterized by:

(a) said means defining said plurality N+1 of valve passages comprising said endcap member, said valve passages being disposed in a generally annular pattern and radially outwardly from said second fluid pressure chamber;

(b) said end surface of said star member defining said first and second pluralities N of fluid ports comprising an end surface in sliding, sealing engagement with the adjacent surface of said endcap member; and (c) said second plurality N of fluid ports is in fluid communication with said second manifold zone by means of a second plurality of fluid passages defined by said end surface of said star member in engagement with said endcap member, whereby all valving action occurs between said end surface of said star member and said adjacent surface of said endcap member.

8. A rotary fluid pressure device as claimed in claim 7 characterized by said housing means including a pressure balance plate disposed on the side of said gerotor gear set opposite said endcap member and including an end surface in engagement with said star member, said end surface defining pressure balancing recess means in fluid communication with said expanding and contract fluid volume chambers, fluid pressure in said pressure balancing recess means being operable to bias said star member into sealing engagement with said endcap member.

* * * * *

UNITED STATES PATENT AND TRADEMARK OFFICE

CERTIFICATE OF CORRECTION

PATENT NO. : 4,741,681

DATED : May 3, 1988

INVENTOR(S) : Marvin L. Bernstrom

It is certified that error appears in the above-identified patent and that said Letters Patent are hereby corrected as shown below:

Please add the following information to the first page of the patent:

"Assignee: Eaton Corporation, Cleveland, Ohio"

"Attorney, Agent, or Firm—D.A.Rowe; L.J.Kasper"

Signed and Sealed this

Eighth Day of November, 1988

*Attest:*

*Attesting Officer*

DONALD J. QUIGG

*Commissioner of Patents and Trademarks*